US007931398B2

(12) United States Patent
Plache

(10) Patent No.: US 7,931,398 B2
(45) Date of Patent: Apr. 26, 2011

(54) FLUID BLENDING METHODS UTILIZING EITHER OR BOTH PASSIVE AND ACTIVE MIXING

(75) Inventor: Paul R. Plache, Boulder, CO (US)

(73) Assignee: Velocity Dynamics, Inc., Boulder, CO (US)

( * ) Notice: Subject to any disclaimer, the term of this patent is extended or adjusted under 35 U.S.C. 154(b) by 851 days.

(21) Appl. No.: 11/900,086

(22) Filed: Sep. 10, 2007

(65) Prior Publication Data

US 2008/0002520 A1 Jan. 3, 2008

Related U.S. Application Data

(62) Division of application No. 10/960,396, filed on Oct. 7, 2004, now Pat. No. 7,267,477.

(51) Int. Cl.
*B01F 7/20* (2006.01)

(52) U.S. Cl. ..... 366/165.2; 366/165.3; 366/165.4

(58) Field of Classification Search .... 366/165.1–165.5, 366/262, 264; 137/812, 813; 415/83, 84, 415/203

See application file for complete search history.

(56) References Cited

U.S. PATENT DOCUMENTS

| | | | | |
|---|---|---|---|---|
| 1,517,598 | A | | 12/1924 | Stevenson |
| 1,816,562 | A | | 7/1931 | Beers |
| 3,267,946 | A | | 8/1966 | Adams et al. |
| 3,324,891 | A | | 6/1967 | Rhoades |
| 3,481,352 | A | | 12/1969 | Starr |
| 3,566,528 | A | * | 3/1971 | Rodgers et al. ..... 95/219 |
| 4,092,013 | A | * | 5/1978 | Staaf ..... 366/165.4 |
| 4,345,841 | A | | 8/1982 | Day |
| 4,664,528 | A | | 5/1987 | Rodgers et al. |
| 4,701,055 | A | | 10/1987 | Anderson |
| 5,018,871 | A | | 5/1991 | Brazelton et al. |
| 5,061,456 | A | | 10/1991 | Brazelton et al. |
| 5,284,626 | A | | 2/1994 | Brazelton et al. |
| 5,284,627 | A | | 2/1994 | Brazelton et al. |
| 5,338,779 | A | | 8/1994 | Brazelton |
| 5,426,137 | A | | 6/1995 | Allen |
| 6,796,704 | B1 | * | 9/2004 | Lott ..... 366/163.2 |
| 2004/0100861 | A1 | * | 5/2004 | Vanden Bussche et al. ..... 366/165.1 |

* cited by examiner

*Primary Examiner* — David L Sorkin
(74) *Attorney, Agent, or Firm* — Harold A. Burdick

(57) ABSTRACT

Fluid blending apparatus and methods are provided, the blending apparatus including components accommodating both passive and/or active mixing. The apparatus for performing the methods include a main body and closure connectable to define a chamber having a fluid outlet. A valved fluid inlet channel opens into the chamber and is tangentially oriented relative to a peripheral wall thereof so that fluid entering the chamber has a primary vortical flow circulation direction. A fluid injection channel opens to the inlet channel at an acute angle relative to direction of fluid flow through the inlet channel. A plurality of barriers is arrayed in the chamber to define interconnected inner and outer chamber portions. An impeller is rotatably mounted at the inner chamber portion and includes a plurality of blades oriented to urge flow from the inner chamber portion to the outer chamber portion.

19 Claims, 4 Drawing Sheets

FLUID BLENDING METHODS UTILIZING EITHER OR BOTH PASSIVE AND ACTIVE MIXING

RELATED APPLICATION

This Application is a Divisional Application of U.S. patent application Ser. No. 10/960,396 entitled Fluid Blending Utilizing Either Or Both Passive And Active Mixing by the inventor herein and filed on Oct. 7, 2004 (U.S. Pat. No. 7,267,477).

FIELD OF THE INVENTION

This invention relates to fluid blending, and, more particularly, relates to apparatus and methods or blending two liquids.

BACKGROUND OF THE INVENTION

Blenders adapted for fluid blending are known and/or utilized in a large variety of applications. In particular, such blenders for blending two or more liquid components have been suggested and/or utilized, where one component is a fragile liquid polymer material requiring special consideration in blending and mixing operations.

Liquid polymer is used, for example, in water and wastewater treatment as a flocculent and coagulant. As supplied, the polymer is suspended in oil and the polymer molecule is coiled. In this form, the polymer is ineffective, and requires activation (i.e., uncoiling) in a dilution process. However, once uncoiled, the elongated polymer molecule is fragile and susceptible to damage. While a relatively high mixing energy is required to activate the molecule in the dilution process, that same high mixing energy may damage the elongated molecule thereafter, thus impairing the effectiveness of the molecule and thus the mixture in the coagulation or flocculation process.

Passive, non-mechanical, mixers using spray nozzles or static mixers are known (see U.S. Pat. Nos. 4,664,528 and 5,426,137) for such applications. Likewise, active (mechanical) mixers utilizing impellers of various configurations are also known (see U.S. Pat. Nos. 5,338,779, 5,284,627, 5,061,456 and 5,018,871).

Mechanical mixers have the benefit of affecting variable mixing energy without reliance on water pressure to create this energy. Such designs, however, often have a high potential for damaging the polymer molecules by contact with impeller blades and the like. This drawback is heightened at low flow rates (throughput) where retention time is greater thus increasing exposure of the molecules to damaging mechanical mixing energy. Moreover, as with all mechanical systems, such blenders are more prone to mechanical failure and blender down time.

Non-mechanical mixers typically rely on high water pressure to produce mixing energy. Thus, such systems lose mixing energy as the flow rate decreases. Moreover, such systems can control mixing energy only when water pressure control is available.

Further improvement in such fluid blending apparatus and methods, directed to improving reliability and effectiveness thereof under a variety of conditions, could thus still be utilized.

SUMMARY OF THE INVENTION

This invention provides improved fluid (primarily liquid) blending apparatus and methods particularly well adapted for use in liquid polymer blending. The apparatus and methods employ either or both active (i.e., mechanical) and passive (i.e., non mechanical) mixing to achieve blending and full activation of blended components as required in differing applications. The apparatus and methods of this invention reduce potential for damaging the fragile fluid component molecules, are effective across a wide range of flow rates, and remain operable even when one of the active or passive mixing is down. The apparatus and methods are not reliant on high water pressure alone to produce mixing energy and can remain in control of mixing even in the absence of water pressure control.

The apparatus of this invention includes a containment formed by a main body and a closure and defines a chamber having first and second spaced walls and a peripheral wall between the first and second walls. A fluid inlet channel and a fluid outlet from the chamber are provided, the inlet channel tangentially oriented relative to the peripheral wall of the chamber and opening thereat so that fluid entering the chamber has a primary vortical flow circulation direction within the chamber. A control valve at the fluid inlet channel controls fluid flow characteristics.

A fluid insertion, or injection, channel opens to the inlet channel, preferably at a point between the control valve and the chamber, and is angularly oriented relative to the inlet channel (preferably at an acute angle relative to direction of fluid flow through the inlet channel). At least one barrier in the chamber oriented between the first and second walls and spaced from the peripheral wall defines interconnected inner and outer chamber portions. Preferably, a plurality of barriers portions are utilized, each of the barrier portions oriented and spaced from the peripheral wall of the chamber substantially similarly.

A plurality of blades is arrayed at the inner chamber portion between the first and second walls. While the blades may be immobile and thus passive in any given operation, the blades are located with an impeller rotatably mounted at the inner chamber portion of the containment. The blades are oriented to urge liquid flow from the inner chamber portion to the outer chamber portion when the impeller is rotated.

One of the methods for blending liquids of this invention is characterized by steps including establishing a high velocity primary liquid stream and angularly inserting a secondary liquid into the primary liquid stream providing a combined flow. Interconnected inner and outer chamber portions within a chamber are defined and a vortical flow circulation direction of the combined flow within the chamber between the inner and outer chamber portions is initiated. The combined flow is selectively mechanically urged from the inner chamber portion to the outer chamber portion. When blended, liquid is discharged from the chamber.

It is therefore an object of this invention to provide improved fluid blending apparatus and methods.

It is another object of this invention to provide improved fluid blending apparatus and methods particularly well adapted for use in liquid polymer blending.

It is still another object of this invention to provide fluid blending apparatus and methods employing either or both active and passive mixing.

It is yet another object of this invention to provide fluid blending apparatus and methods that reduce potential for damaging fragile fluid component molecules, that are effective across a wide range of flow rates, and that are highly reliable.

It is another object of this invention to provide fluid blending apparatus and methods that are not reliant on high water pressure alone to produce mixing energy and that can retain control of mixing even in the absence of water pressure control.

It is yet another object of this invention to provide a fluid blending apparatus including a containment defining a chamber having first and second spaced walls and a peripheral wall between the first and second walls, the containment including a fluid inlet channel and a fluid outlet from the chamber, the inlet channel tangentially oriented relative to the peripheral wall of the chamber and opening thereat so that fluid entering the chamber has a primary vortical flow circulation direction within the chamber, the containment having at least a first barrier defined in the chamber oriented between the first and second walls and spaced from the peripheral wall of the chamber to define interconnected inner and outer chamber portions, the containment further including a fluid insertion channel angularly oriented relative to the inlet channel and opening to the inlet channel at a point adjacent to the chamber, and a plurality of blades arrayed at the inner chamber portion between the first and second walls.

It is still another object of this invention to provide a blender for mixing aqueous liquid with a liquid polymer, the blender including a containment including a main body and closure connectable with the main body, the containment defining a chamber having a first wall at the closure, a second wall at the main body and a peripheral wall between the first and second walls, a fluid inlet channel defined through the containment and tangentially oriented relative to the peripheral wall of the chamber and opening thereat so that fluid entering the chamber has a primary vortical flow circulation direction within the chamber, a control valve at the fluid inlet channel for controlling fluid flow characteristics, a fluid injection channel defined through the containment and opening to the fluid inlet channel between the control valve and the chamber at an acute angle relative to direction of fluid flow through the inlet channel, a plurality of barriers arrayed in the chamber between the first and second walls, each of the barriers oriented and spaced from the peripheral wall of the chamber substantially similarly to thereby define interconnected inner and outer chamber portions, an impeller rotatably mounted at the inner chamber portion of the containment, the impeller including a plurality of blades extending between the first and second walls and oriented to urge liquid flow from the inner chamber portion to the outer chamber portion when the impeller is rotated, and a fluid outlet from the chamber defined through the containment.

It is yet another object of this invention to provide a method for blending liquids wherein the steps of the method include establishing a high velocity primary liquid stream, angularly inserting a secondary liquid into the primary liquid stream providing a combined flow, defining interconnected inner and outer chamber portions within a chamber, initiating a vortical flow circulation direction of the combined flow within the chamber between the inner and outer chamber portions, selectively mechanically urging the combined flow from the inner chamber portion to the outer chamber portion, and discharging blended liquid from the chamber.

With these and other objects in view, which will become apparent to one skilled in the art as the description proceeds, this invention resides in the novel construction, combination, and arrangement of parts and method substantially as hereinafter described, and more particularly defined by the appended claims, it being understood that changes in the precise embodiment of the herein disclosed invention are meant to be included as come within the scope of the claims.

BRIEF DESCRIPTION OF THE DRAWINGS

The accompanying drawings illustrate a complete embodiment of the invention according to the best mode so far devised for the practical application of the principles thereof, and in which.

DESCRIPTION OF THE INVENTION

Figure 2:
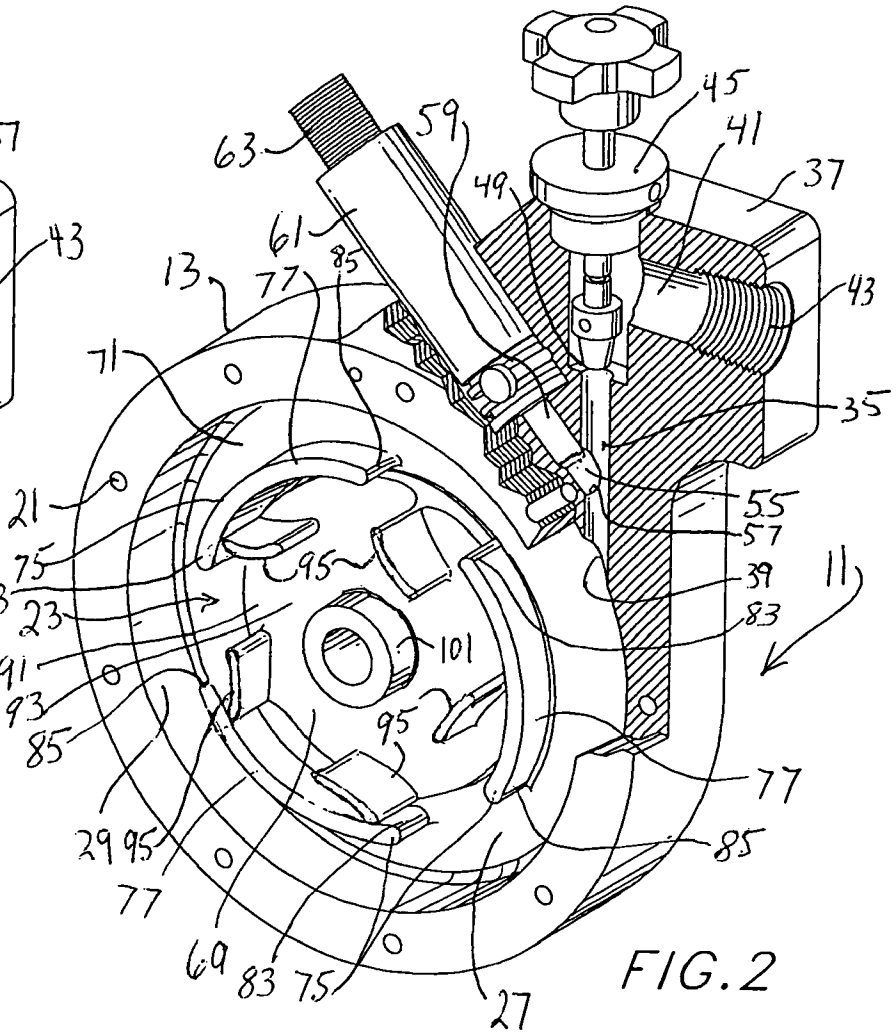
FIG. 2 is a partially cut away view of the apparatus of FIG. 1 with the top flange removed.
Figure 1:
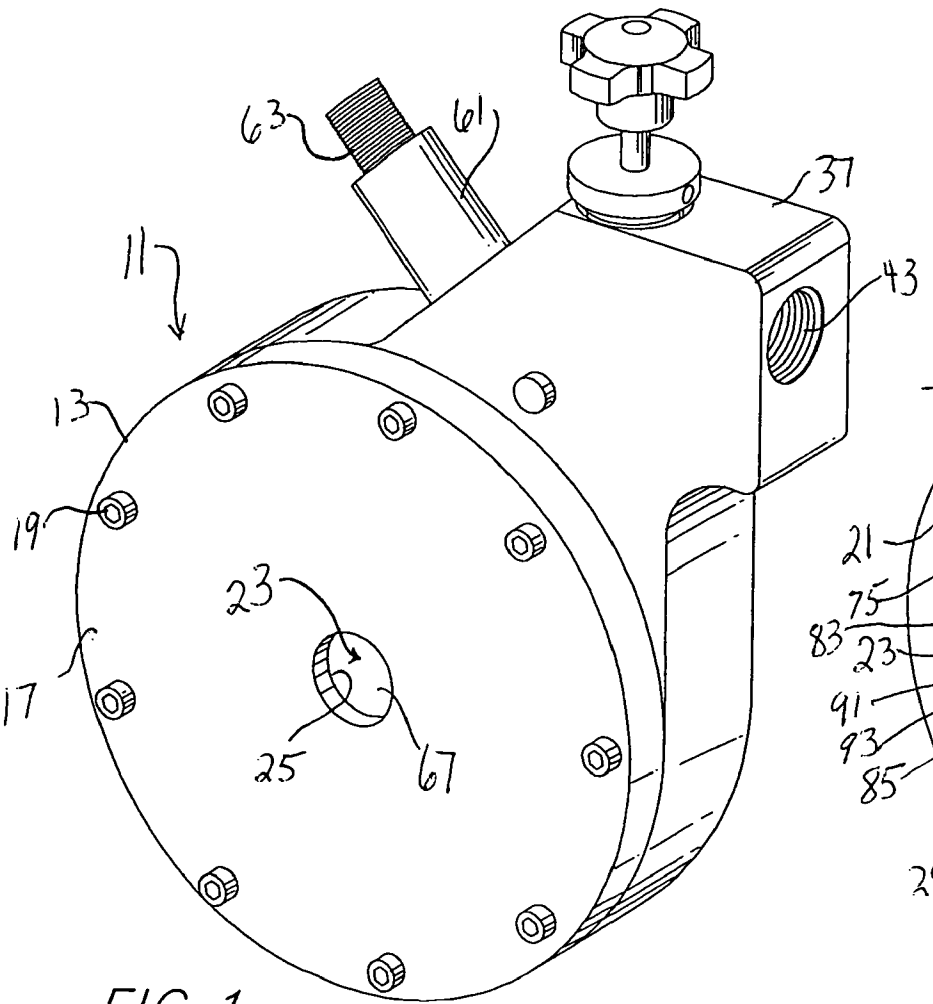
FIG. 1 is a perspective view of a first embodiment of the apparatus of this invention.

A first embodiment of the blending apparatus of this invention (blender 11) is illustrated in FIGS. 1 and 2. The apparatus includes containment vessel 13 established by main body 15 and closure flange (or flanges) 17 connected by appropriate means (for example using bolts 19 in threaded openings 21 of main body 15). Containment vessel 13 defines internal chamber 23 having first wall 25 at flange 17 (better shown in FIGS. 3 and 4 with respect to the second embodiment of the apparatus), a second wall 27 at main body 15, and an arcuate peripheral wall 29 between walls 25 and 27. The volume of chamber 23 may be varied by increasing diameter and/or depth thereof, thus varying pressure drop, retention time and velocity at various flow ranges. Peripheral wall 29 is preferably substantially cylindrical for reasons apparent as the description proceeds.

Primary fluid inlet channel 35 is formed in main body feed extension portion 37 and opens at port 39 to chamber 23. Channel 35 is tangentially oriented relative to peripheral wall 29 so that fluid entering chamber 23 through channel 35 has a primary vortical flow circulation direction within chamber 23 (see FIG. 7). Channel 35 is supplied from supply channel 41 having external fluid connection opening 43 at one end thereof. Primary fluid flow characteristics are controlled at control valve 45. Valve 45 produces a selected pressure drop responsive to variable valve opening and closure across opening 49 to channel 35 allowing control over the flow rate/input volume through the valve as well as selectively producing a high velocity water jet downstream of the valve (a standard flow control valve of any known character may be utilized).

Secondary fluid insertion channel 55 is formed in main body feed extension portion 37 and opens at port 57 to channel 35 between opening 49 and port 39 (thus in relatively close proximity to both openings). Channel 55 is angularly oriented relative to channel 35, an acute fluid insertion path angle relative to fluid flow direction in channel 35 of less than about 60° being preferred (and more preferably about 45°). The secondary fluid is preferably injected into channel 35 through injection quill 59 held at main body mount 61 (which may include a check valve) having supply connection 63 at one end thereof. Discharge outlet 67 for withdrawal of mixed fluid from chamber 23 is located at flange 17 at inner chamber portion 69 of chamber 23.

Interconnected inner chamber portion 69 and outer chamber portion 71 are defined in chamber 23 by barrier structure 75, preferably established by a plurality of barrier portions 77 (though other arrangements for the barrier could be conceived, including a monolithic barrier with openings or use of greater or fewer barrier portions). Barrier portions 77 are linearly arrayed arcuate structures having similar orientation and spacing, each having a leading edge 83 and a trailing edge 85 (relative to the direction of vortical flow), the leading edges of any one of portions 77 being adjacent to and spaced from the trailing edge of a different one of portions 77. Trailing edge 85 of each barrier portion 77 is preferably offset from its leading edge 83 toward peripheral wall 29 by about 2° or more. Barrier structure 75 preferably has a height substantially equivalent to the depth of chamber 23 (i.e., equal to the height of peripheral wall 29), but may have a height less than chamber depth.

Mixing impeller assembly 91 is located at main body 15 adjacent to second wall 27 at inner chamber portion 69. The details of impeller assembly operation and mounting will be explained with respect to the embodiment of the invention illustrated by FIGS. 3 through 6 (impeller details in all embodiments herein being substantially the same). Impeller 93 is characterized by a circular upper surface having blades 95 selectively arrayed thereat. Blades 95 are preferably slightly arcuate and of a selected height (preferably slightly less than chamber depth, though height may be decreased or increased depending on desired mixing energy). The number of blades 95 may be fewer or greater than shown in the FIGURES. Blades 95 are located on the edge of impeller 93 and are oriented at an angle, the arcuate shape and orientation of blades 95 selected to produce velocity urging fluid from inner chamber portion 69 to outer chamber portion 71 through the openings in barrier structure 75 for recirculation and creating turbulence in outer chamber portion 71. Impeller 93 is connected at central hub 101 to a stainless steel drive shaft of a variable speed motor as discussed hereinafter. When not active, blades 95 of impeller 93 serve as little more than passive mixing elements (similar to static mixer elements). If, in a particular installation, active mixing is not needed, the entire impeller assembly 91 can be readily removed from the apparatus if desired.

A second embodiment of the invention (blender 105) is illustrated in FIGS. 3 through 6. This embodiment includes many of the same features as heretofore described and which are identified by the same numerals, with those portions not shown or discussed being substantially identical to features of the first embodiment described hereinabove. Blender 105 is configured for greater flow rates with increased capacity at chamber 23.

Closure flange 109 is configured (machined, for example) with an internal volume 111, unlike flange 17 in the prior embodiment which has a flat configuration. Internal volume 111 defines wall 25 at the end thereof and peripheral wall segment 29' which, together with peripheral wall segment 29" at main body 15, form chamber 25 peripheral wall 29. Flange 109 includes a plurality of barrier segments 115 arrayed at internal volume 111, segments 115 preferably equal in number and length to barrier portions 77 at main body 15. The height, positioning and orientation of barrier segments 115 and barrier portions 77 are selected so that, upon securement of closure flange 109 and main body 15, each barrier segment 115 is adjacent (either touching or nearly so) a barrier portion 77 forming a barrier structure from wall 25 to wall 27 defining interconnected inner and outer chamber portions 69 and 71 of chamber 23.

Ring seal 121 is located in annular groove 123 of flange 109 (this same arrangement applies with respect to first embodiment flange 17) for sealing the engagement between the flange and main body 15. Impeller blades 123 of impeller 125 have increased height in this embodiment in view of the increased depth of chamber 23.

Figure 3:
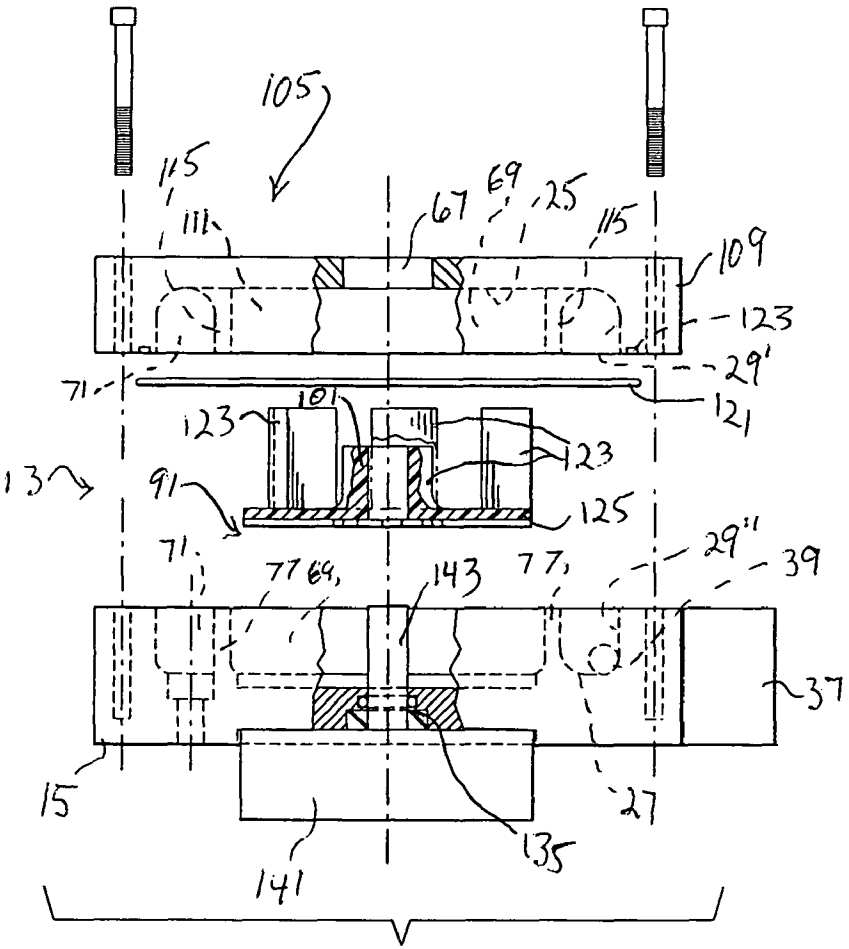
FIG. 3 is an exploded side view illustration of a second embodiment of this invention.
Figure 4:
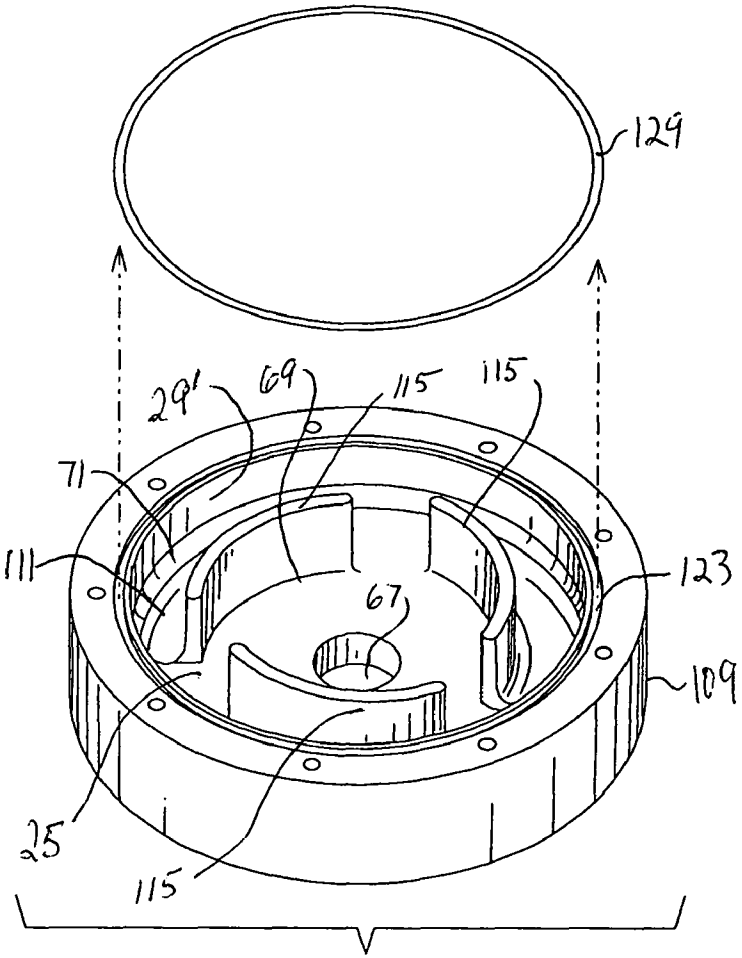
FIG. 4 is a perspective exploded view of the machined top flange and seal of the apparatus of FIG. 3.
Figure 5:
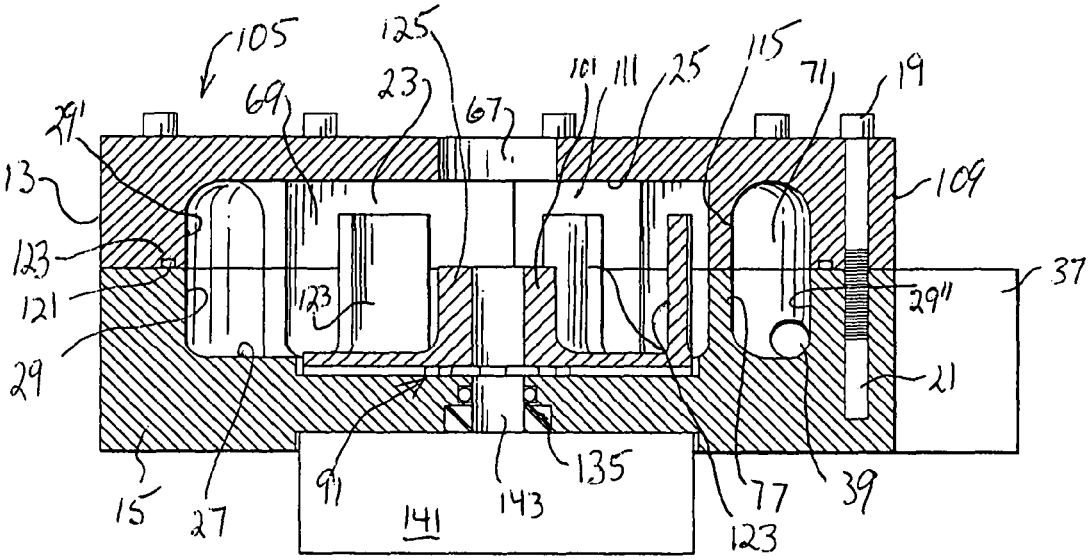
FIG. 5 is an assembled sectional view of the apparatus of FIG. 3.

Regarding impeller 125, arcuate channels 131 are formed on rear surface 133 thereof and are shaped, in conjunction with primary rotation direction of impeller 125, to create a negative pressure at the area of shaft seal 135 to prevent leakage past the seal in case of seal failure (this configuration may be utilized with any of the embodiments of the blender apparatus shown herein). Regarding details of impeller assembly 91 applicable in all embodiments of the blender apparatus of this invention, as shown in FIGS. 3 and 5, variable speed motor 141 drives impeller 125/93 via drive shaft 143. The shaft is sealed using a mechanical seal, packing gland, lip seal, or a combination of seal types.

Figure 7:
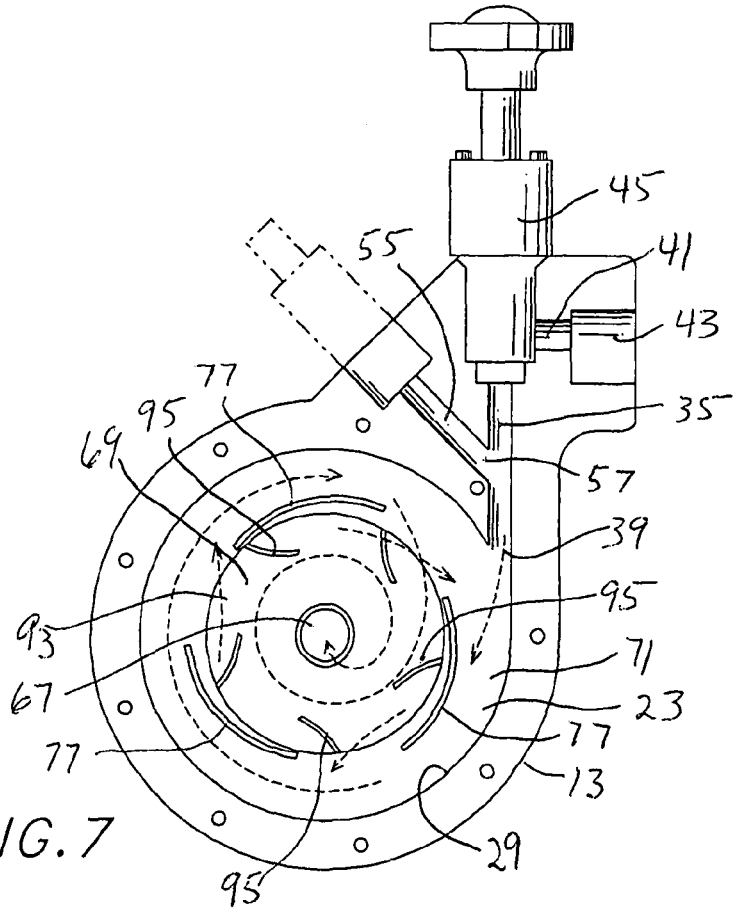
FIG. 7 is a flow diagram illustrating operation of the apparatus of this invention.

Turning now to FIG. 7, flow of the primary fluid (water or aqueous liquid mixture, for example) enters the blender apparatus of this invention through supply channel 41. Primary flow characteristics are controlled by adjustment of valve 45 (though a fixed orifice could be utilized), establishing, when desired, a high velocity stream in channel 35. The secondary fluid (liquid polymer concentrate or solution, for example) is injected into channel 35 downstream from valve 45 but prior to entry into outer chamber portion 71 of chamber 23 through channel 55, thus more effectively making use of energy from water pressure and the high velocity stream for polymer activation (the secondary fluid being thus initially blended with the primary fluid in channel 35 prior to entry to chamber 23).

The combined flow entrained in the high velocity stream is then passed through port 39 into outer chamber portion 71 of chamber 23 tangentially to peripheral wall 29 thus establishing the primary vortical flow circulation direction within chamber 23. The flow entering the chamber circulates, traveling from outer chamber portion 71 to inner chamber portion 69. Rotation of impeller 93 provides secondary (and, in the case of loss of water pressure, primary), variable intensity, mixing energy, causing recirculation of the combined flow (from inner chamber portion 69 to outer chamber portion 71 and back again) and introducing turbulence into outer chamber portion 71 independent of water head velocity at opening 39. In case of power outage, mixing may be adequately accomplished in most cases by passive, non-mechanical (water pressure based) mixing alone. In the case of water pressure drop or inadequacy, mixing may be adequately accomplished in most cases by active, mechanical (using the impeller assembly) mixing alone. The blended fluid is discharged through outlet 67 (which is connected with further plumbing directing the flow to its point of use).

Figure 8:
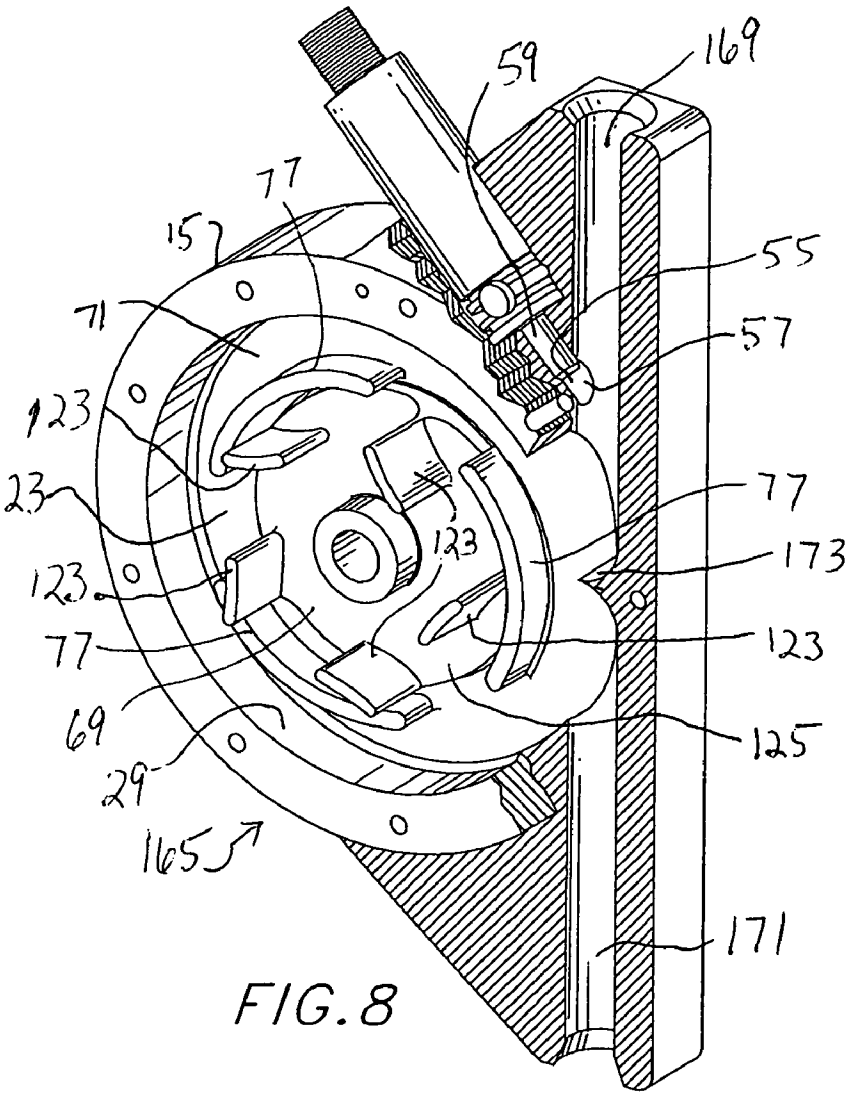
FIG. 8 is a partially cut away view of a third embodiment of the apparatus of this invention with the top flange removed.
Figure 6:
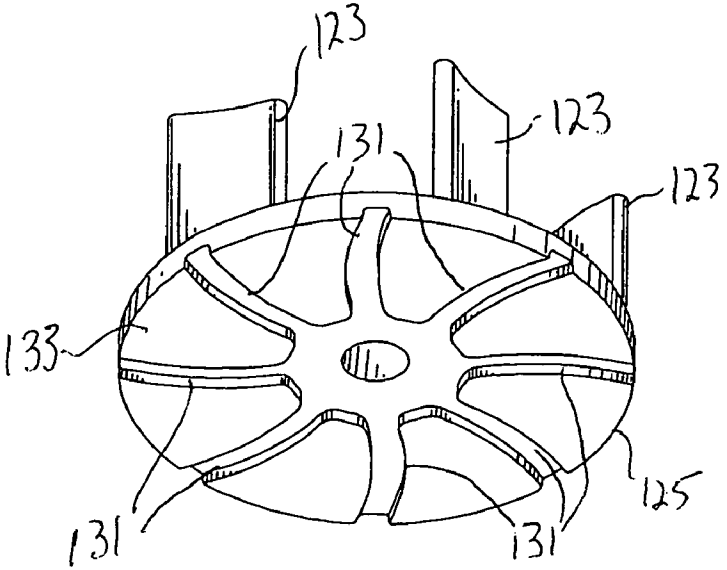
FIG. 6 is rear view of the impeller of the apparatus of either FIG. 3.

FIG. 8 illustrates yet another embodiment of the apparatus of this invention (blender 165) similar in most regards to those previously described and capable of utilizing either type of closure flange 17 or 109 (not shown). Elements common to prior embodiments are either identified by the same numerals or are not discussed, only those changes in the embodiment from prior descriptions being elaborated upon. This embodiment is particularly adapted for use with greater flow volumes, as might be found for example where the primary fluid input is sludge and the secondary fluid is preactivated liquid polymer in solution. In such case, higher volume input channel 169 is provided (a control valve for flow on/off and or volume/velocity flow control may be utilized) to accommodate such material flows.

This embodiment also illustrates a feature which may be employed for any of the embodiments heretofore set forth.

Discharge may be accomplished at outer peripheral wall 29 of chamber 23 utilizing discharge outlet channel 171 (thus replacing outlet 67, which opening in flanges 17/109 would not be present). Baffle 173 diverts incoming fluid flow internally to chamber 23 thus preventing short-circuiting of flow through the chamber (other means for preventing such short-circuiting of flow could be used, such as a variable tension plate valve or the like).

As may be appreciated from the foregoing, improved blenders and blending methods particularly well adapted for use in liquid polymer blending are provided wherein both active (i.e., mechanical) and passive (i.e., non mechanical) mixing is accommodated, the blenders utilized to achieve blending and full activation of blended liquids as required in differing applications. The blenders are constructed of materials typically utilized for such applications (PVC, stainless steel, acrylic, LEXAN, or other suitable materials) and are manufactured and assembled using convention techniques.

What is claimed is:

1. A method for blending liquids comprising the steps of:
establishing a high velocity primary liquid stream;
angularly inserting a secondary liquid into said primary liquid stream providing a combined flow;
defining interconnected inner and outer chamber portions within a chamber;
initiating a vortical flow circulation direction of said combined flow within said chamber between said inner and outer chamber portions;
selectively mechanically urging said combined flow from said inner chamber portion to said outer chamber portion; and
discharging blended liquid from said chamber.

2. The method of claim 1 wherein the step of defining interconnected inner and outer chamber portions includes positioning plural barriers in said chamber linearly arrayed relative to one another and to said flow circulation direction.

3. The method of claim 1 wherein the step of discharging blended liquid includes one of discharging at said inner chamber portion and discharging tangentially from said outer chamber portion.

4. The method of claim 1 wherein the step of urging said combined flow form said inner chamber portion to said outer chamber portion includes rotating blades at a selected speed at said inner chamber portion.

5. The method of claim 1 further comprising controlling one of velocity and volume of flow of said primary fluid stream.

6. The method of claim 1 wherein the step of inserting a secondary fluid includes injecting said secondary fluid into said primary fluid stream through an angularly oriented injection quill.

7. A fluid blending method comprising the steps of:
flowing fluid at a high velocity into a chamber tangentially so that a primary vortical flow circulation direction within the chamber is established;
positioning an intermediate barrier to flow in the chamber thereby defining in the chamber an outer flow area surrounding an interconnected inner flow area;
angularly orienting a fluid insertion into the flowing fluid adjacent to the chamber;
actively urging mixed fluid from the inner flow area to the outer flow area; and
flowing the mixed fluid out of the chamber at the inner flow area.

8. The blending method of claim 7 wherein the step of actively urging mixed fluid from the inner flow area includes rotating blades in the inner flow area.

9. The blending method of claim 7 wherein the step of positioning an intermediate barrier to flow includes dividing the barrier to provide plural flow openings.

10. The blending method of claim 9 wherein the step of dividing the barrier includes angularly offsetting barrier portions with the chamber.

11. The blending method of claim 7 wherein the step of angularly orienting a fluid insertion includes insertion into the flowing fluid at an angle less than about 60° relative to direction of fluid flow.

12. The blending method of claim 7 further comprising the step of selectively controlling fluid flow velocity into the chamber.

13. A method for mixing aqueous liquid with a liquid polymer, said method comprising the steps of:
establishing a flow of aqueous liquid;
injecting a liquid polymer into the flow of aqueous liquid at an acute angle relative to direction of fluid flow;
containing a vortical flow of the combined aqueous liquid and liquid polymer;
controlling velocity of flow of the aqueous liquid to control selected fluid flow characteristics of the vortical flow;
impeding flow between an outer flow area of the vortical flow and a surrounded inner flow area of the vortical flow; and
rotationally urging flow of the combined aqueous liquid and liquid polymer from the inner flow area to the outer flow area to enhance fluid mixing.

14. The mixing method of claim 13 further comprising the step of withdrawing mixed fluid from the inner flow area.

15. The mixing method of claim 13 wherein the step of impeding flow includes arraying offset barriers between said inner and outer flow areas.

16. The mixing method of claim 15 wherein the step of arraying offset barriers includes establishing about a 2° offset between leading and trailing barrier edges relative to direction of the vortical flow.

17. The mixing method of claim 13 wherein the step of rotationally urging flow includes rotating an impeller located at the inner flow area at a selectively variable rate.

18. The mixing method of claim 13 wherein the step of controlling velocity of flow includes producing a selected high velocity liquid stream.

19. The mixing method of claim 13 further comprising the step of withdrawing mixed fluid tangentially from the outer flow area.

* * * * *